US007272566B2

(12) United States Patent
Vinton

(10) Patent No.: US 7,272,566 B2
(45) Date of Patent: Sep. 18, 2007

(54) REDUCING SCALE FACTOR TRANSMISSION COST FOR MPEG-2 ADVANCED AUDIO CODING (AAC) USING A LATTICE BASED POST PROCESSING TECHNIQUE

(75) Inventor: Mark Stuart Vinton, San Francisco, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 801 days.

(21) Appl. No.: 10/336,637

(22) Filed: Jan. 2, 2003

(65) Prior Publication Data

US 2004/0131204 A1 Jul. 8, 2004

(51) Int. Cl.
*G10L 19/00* (2006.01)

(52) U.S. Cl. ..... 704/500; 704/200.1; 704/503; 704/229

(58) Field of Classification Search ..... 704/200.1, 704/500–504, 230, 229, 219; 375/242, 253
See application file for complete search history.

(56) References Cited

U.S. PATENT DOCUMENTS 5,581,653 A 12/1996 Todd ..... 395/2.38
5,956,674 A * 9/1999 Smyth et al. ..... 704/200.1
6,226,616 B1 * 5/2001 You et al. ..... 704/500
6,430,533 B1 * 8/2002 Kolluru et al. ..... 704/500
6,757,658 B1 * 6/2004 Kolluru et al. ..... 704/500
6,934,677 B2 * 8/2005 Chen et al. ..... 704/200.1
7,027,982 B2 * 4/2006 Chen et al. ..... 704/230

OTHER PUBLICATIONS

Aggarwal et al., ("Trellis-based optimization of MPEG-4 Advanced audio coding", IEEE workshop on Speech Coding. Proceedings, Meeting the Challenges of the new Millenium, Sep. 17, 2000, pp. 142-144).*
Lau et al., ("A Common Transform Engine For MPEG & AC3 Audio Decoder," ICCI Conference on Consumer Electronics, 1997, Digest of Technical Papers, Jun. 11-13, 1997, pp. 202-203), 559-566.*
Tsai et al., ("An MPEG audio decoder chip", IEEE Transactions on Consumer Electronics, Feb. 1995, vol. 41, Issue 1, pp. 89-96).*

(Continued)

*Primary Examiner*—Vijay Chawan
(74) *Attorney, Agent, or Firm*—Gallagher & Lathrop; Thomas A. Gallagher

(57) ABSTRACT

A perceptual encoder divides an audio signal into successive time blocks, each time block is divided into frequency bands, and a scale factor is assigned to each of ones of the frequency bands. Bits per block increase with scale factor values and band-to-band variations in scale factor values. A preliminary scale factor for each of ones of the frequency bands is determined, and the scale factors for the each of ones of the frequency bands is optimized, the optimizing including increasing the scale factor to a value greater than the preliminary scale factor value for one or more of the frequency bands such that the increase in bit cost of the increasing is the same or less than the reduction in bit cost resulting from the decrease in band-to-band variations in scale factor values resulting from increasing the scale factor for one or more of the frequency bands.

10 Claims, 3 Drawing Sheets

OTHER PUBLICATIONS

Li et al., ("An AC-3 MPEG multi-standard audio decoder IC," Proceedings of Custom Integrated Circuits Conference, 1997, May 5-8, 1997, pp. 245-248).*

Aggarwal. A., et al., "Trellis-Based Optimization of MPEG-4 Advanced Audio Coding," IEEE Workshop on Speech Coding Proceedings. Meeting the Challenges of the New Millennium, Sep. 17, 2000, pp. 142-144.

Bosi, M., et al., "ISO/IEC MPEG-2 Advanced Audio Coding," Journal of the Audio Engineering Society, Audio Engineering Society, New York, vol. 45, No. 10, Oct. 1, 1997, pp. 789-812.

"Digital Audio Compression (AC-3) Standard." Approved Nov. 10, 1994. (Rev 1) Annex A added Apr. 12, 1995. (Rev 2) 13 corrigendum added May 24, 1995. (Rev 3) Annex B and C added Dec. 20, 1995.

"ISO/IEC MPEG-2 Audio Coding" by Bosi et al. presented at the 101st Convention Nov. 8-11, 1996, Los Angeles, Audio Engineering Society Preprint 4382).

Princen et al, "Analysis/synthesis filter bank design based on time domain aliasing cancellation," IEEE Trans. Acoust., Speech, Signal Processing, vol. ASSP-34, pp. 1153-1161, Oct. 1986.

"Increased Efficiency MPEG-2 AAC Encoding," by Smithers et al, Audio Engineering Society Convention Paper, Presented at the 111th Convention Sep. 21-24, 2001. New York.

Chapter 15 ("Tree and Trellis Encoding") of Vector Quantization and Signal Compression by Allen Gersho and Robert M. Gray, Kluwer Academic Publishers, Boston, 1992, pp. 555-586.

* cited by examiner

REDUCING SCALE FACTOR TRANSMISSION COST FOR MPEG-2 ADVANCED AUDIO CODING (AAC) USING A LATTICE BASED POST PROCESSING TECHNIQUE

BACKGROUND OF INVENTION

Typical transform and filter-bank audio coding techniques such as MPEG-1 layers 1 through 3, Dolby AC-3 (also known as Dolby Digital) (Dolby, Dolby Digital and Dolby AC-3 are trademarks of Dolby Laboratories Licensing Corporation), and MPEG-2 Advanced Audio Coding (AAC) reduce transmission data rates by dynamically allocating bits in both time and frequency to remove inaudible redundancies in the audio signal. The dynamic allocation of bits is typically based on signal dependent psychoacoustic principles. Further details of Dolby AC-3 may be found in Digital Audio Compression (AC-3) Standard. Approved Nov. 10, 1994. (Rev 1) Annex A added Apr. 12, 1995. (Rev 2) 13 corrigendum added 24, May 1995. (Rev 3) Annex B and C added 20, Dec. 1995. Further details of AAC may be found in "ISO/IEC MPEG-2 Audio Coding by Bosi et al, presented at the 101$^{st}$ Convention 1996 Nov. 8-11, 1996, Los Angeles, Audio Engineering Society Preprint 4382).

In AAC, bit allocation is achieved using scale factors and global gain parameters contained in the bit stream. The audio spectrum, transformed using a well-known modified discrete cosine transform (MDCT) known as time domain alias cancellation (TDAC) (see Princen et al, "Analysis/synthesis filter bank design based on time domain aliasing cancellation," IEEE Trans. Acoust., Speech, Signal Processing, Vol. ASSP-34, pp. 1153-1161, October 1986), is partitioned into bands of approximately half critical bandwidth and the scale factors are applied multiplicatively. The scale factors and global gain jointly represent bit allocation in 1.5 dB steps or approximately quarter bit increments (the exact bit allocation achieved is dependent on the stochastic characteristics of the audio signal and is further complicated by the non-linear quantizer incorporated in AAC). Increasing the scale factor in a band effectively reduces the quantization noise in that band by allocating more bits to that band. Conversely, decrementing a scale factor increases the quantization noise in a particular band by reducing the bits allocated to it.

Because AAC is a forward adaptive audio encoding system, the scale factors are conveyed to the decoder. This is achieved by differentially coding the scale factors and then Huffman coding the differences. The Huffman codes defined in the AAC standard, are such that large variations in the scale factor parameters from band to band lead to excessive consumption of the available bits in the form of side information, which complicates the scale factor derivation as explained in the next section.

Scale Factor Calculation

Calculating the scale factors in an AAC encoder is a very difficult problem due to the uncertainty in the noise allocation achieved by altering the scale factors and the use of a non-linear quantizer stage. Two techniques are commonly used in AAC to calculate scale factors, namely analysis-by-synthesis and estimation directly from the masking model, which are described below. While the selection of the scale factors can be arbitrary, within some limitation imposed by the standard, these two techniques are the best known.

Scale Factor Calculation Using Analysis-by-synthesis

Scale factor calculation using analysis-by-synthesis is achieved using two nested loops, an inner loop responsible for quantization and bit counting and an outer loop, which analyzes the inner loop's result and alters the scale factors accordingly.

The inner loop alters the global gain parameter contained in the AAC bit stream to ensure that the number of bits used to code the audio spectrum is no more than the number of bits available. The global gain is set to an initial value and the spectrum is quantized. The numbers of bits used are then counted. If the number of bits used is greater than the number of bits available, then the global gain is increased and the spectrum is again quantized and the number of bits used are recounted. This process repeats until the number of bits used is less than the number of bits available. The inner loop is often referred to as a "rate loop" because it controls the coding bit rate.

The outer loop analyzes the result achieved by the inner loop and alters the scale factors such that the quantization noise in each band meets psychoacoustic requirements as closely as possible. The outer loop starts with all scale factors set to zero and the inner loop is called to quantize the spectrum. The distortion (quantizing noise) in each band is then calculated and compared to the noise requirements for each band as calculated by the psychoacoustic model. If the distortion in any band is greater than the allowable distortion calculated by the psychoacoustic model, then the scale factor for that band is incremented. The inner loop is again called with the adjusted scale factors and the process repeats until (1) the distortion in all bands is less than the masking level calculated by the psychoacoustic model or (2) all scale factors have been increased.

The analysis-by-synthesis technique suffers from several problems; first, the technique is extremely complex and, consequently, is not appropriate for complexity-constrained applications. Furthermore, the dual loop process described above does not guarantee convergence on an optimal solution; however, at higher data rates it has been shown to produce excellent results.

Scale Factor Estimation From the Masking Level

By assuming that increasing the scale factor by one unit in a band leads to a 1.5 dB reduction in quantization distortion in that band (an increase in signal-to-noise ratio) (both the global gain and scale factors are quantized in 1.5 dB steps), the scale factors can be derived directly from the masking model as described in "Increased efficiency MPEG-2 AAC Encoding," by Smithers et al, Audio Engineering Society Convention Paper, Presented at the 111$^{th}$ Convention, 2001 Sep. 21-24, New York. For this technique, the scale factors are first calculated directly from the masking model, for example, by using the expression set forth below in EQN. 1, where $s_i$ is the scale factor for the i$^{th}$ band and $m_i$ is the masking level in the i$^{th}$ band calculated by the psychoacoustic model.

$$s_i = -\frac{2}{\log_{10}(2)} \cdot \log_{10}(m_i) \qquad \text{(EQN. 1)}$$

The spectrum is then quantized using the inner loop (or rate loop) described in the previous section, thus eliminating the need for the high complexity outer loop. While this technique is much simpler than the analysis-by-synthesis technique described in the previous section, and thus is appropriate for complexity-constrained systems, the calculation of the scale factors from the masking model generates scale factors that exhibit higher variation from band to band than those generated by the two loop analysis-by-synthesis technique. Because the scale factors are differentially coded and then Huffman coded (larger differences imply longer Huffman code words), high variation in the scale factors means that the bit cost of transmitting the scale factors is very high, which degrades the performance of the scale factor estimation from the masking level technique.

SUMMARY OF INVENTION

The present invention is directed to a method for reducing the total bit cost of a perceptual audio encoder employing adaptive bit allocation in which a time domain representation of an audio signal is divided into successive time blocks, each time block is divided into frequency bands, and a scale factor is assigned to each of ones of the frequency bands, wherein the number of bits required to represent each block increases with increases in the scale factor values and with increases in band-to-band variations in scale factor values. A preliminary scale factor for each of ones of the frequency bands is determined, and the scale factors for the each of ones of the frequency bands is optimized, the optimizing including increasing the scale factor to a value greater than the preliminary scale factor value for one or more of the frequency bands such that the increase in bit cost of the increasing is the same or less than the reduction in bit cost resulting from the decrease in band-to-band variations in scale factor values resulting from increasing the scale factor for one or more of the frequency bands.

Neither of the techniques described above for calculating scale factors in AAC explicitly takes into account the cost of transmitting the scale factors to the decoder. In particular, the simpler direct derivation technique can allow the scale factor transmission cost to exceed 10% (at 128 kbps for stereo material) of the overall data rate available for audio transmission, thus degrading the decoded performance. To address this problem, the present invention employs a dynamic programming optimization technique, including, for example, a trellis and a Viterbi search algorithm, to reduce the bit cost of transmitting scale factor information in AAC (MPEG-2/4 Advanced Audio Coding). The invention minimizes a cost function that trades off the cost of transmitting the scale factors against the cost of shifting the scale factors from preliminary values derived by a preliminary scale factor calculation technique. In particular, scale factors having lower values than others may be shifted to higher values in order to reduce the extent of variations in scale factor value from one scale factor band to the next. Although an increase in scale factor value causes more bits to be assigned to a scale factor band, there is an overall bit savings in reducing the degree of band-to-band variations in scale factor values because differences from band to band are Huffman encoded such that the code length increases with increasing band-to-band variations. The overall bit savings makes more bits available to the quantizer for assignment to scale factor bands other than those in which the scale factor value is increased for the purpose of reducing band-to-band variations, thereby resulting an improvement in perceived audio quality.

Although the invention is applicable to forms of AAC that employ two nested loops in the quantizer to derive preliminary scale factors, both an inner iteration loop and an outer iteration loop (as described in the above-cited Bosi et al paper), the invention is particularly beneficial when employed in a form of AAC in which the outer loop, which calculates quantizer error and derives scale factors using analysis-by-synthesis, is omitted and preliminary scale factors are estimated using the masking threshold derived by the perceptual model portion of the AAC encoder. Such a modified form of AAC is described in the above-identified convention paper of Smithers et al. The dynamic programming technique in accordance with the present invention is substantially less complex computationally than the omitted outer loop, but results in encoded signal having substantially the same quality as that produced by an AAC encoder employing two nested loops.

DETAILED DESCRIPTION OF THE INVENTION

Figure 1:
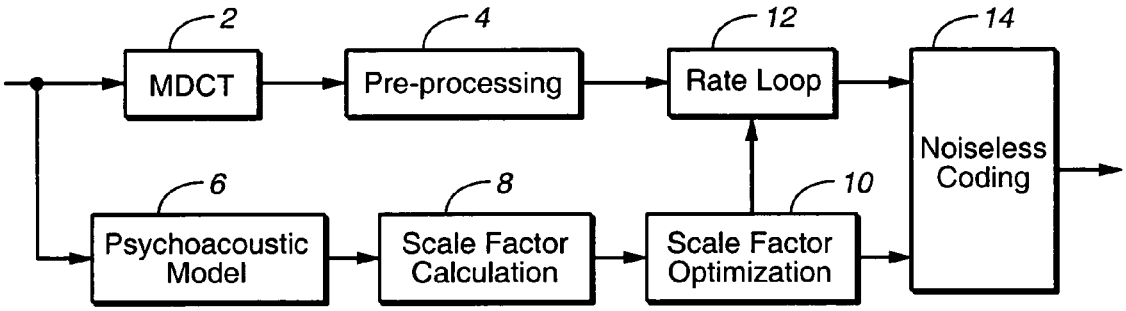
FIG. 1 is a functional schematic block diagram of an encoding process incorporating dynamic programming scale factor optimization according to the present invention.

FIG. 1 shows a simple, high level schematic of an AAC encoding process incorporating dynamic programming scale factor optimization according to the present invention. The figure shows the scale factor optimization according to the present invention in conjunction with the direct scale factor estimation from masking model information described above. While other scale factor derivation techniques may be improved using the teachings of this invention, the invention is particular suitable for use with this direct estimation technique.

In FIG. 1, the input audio is transformed using an MDCT 2, followed by pre-processing 4 (e.g., temporal noise shaping (TNS), prediction and middle-side coding (MS) for stereo applications). The input is also passed to a psychoacoustic model 6, which calculates the masking level. As explained above, the masking model is used directly to compute the scale factors for each band ("scale factor calculation" 8). While the preliminary scale factors derived by this technique approximate the psychoacoustic requirement quite closely, the high band-to-band variation in the scale factor values lead to a high transmission cost. To minimize this cost, scale factor optimization 10 according to the present invention processes the preliminary scale factors prior to their application to the MDCT spectrum in the rate loop 12 and noiseless coding (differential Huffman coding) 14.

It is assumed that increasing the value of a scale factor by one unit in a band increases the number of bits used in that band by a quarter bit per MDCT coefficient. While this is not always accurate due to the unknown stochastic nature of the signal and the non-uniform quantizer used in AAC, on the average it is a reasonable assumption. It is further assumed that preliminary scale factors have already been determined for appropriate psychoacoustic performance, either by the analysis-by-synthesis or by direct-masking-estimation techniques. The following cost formula trades off the cost of the scale factor transmission against the cost of applying more bits to a particular band. The cost function is given below in EQN. 2.

$$C = \sum_i \left( \alpha_i \frac{(\tilde{s}_i - s_i)}{4} B_i + D(\tilde{s}_i - \tilde{s}_{i-1}) - D(s_i - s_{i-1}) \right) \quad \text{(EQN. 2)}$$

In EQN. 2, C is the overall cost of shifting the scale factors, which should be made as negative as possible in order to reduce the relative cost of scale factor transmission. The symbol $s_i$ represents the preliminary scale factors derived, for example, for psychoacoustic considerations by either of the techniques discussed above. Further, $\tilde{s}_i$ is the new set of scale factors in EQN. 2 and $B_i$ is the number of coefficients in the $i^{th}$ scale factor band. The function D( ) is the Huffman lookup of the differential encoded scale factors. The per-band scale $\alpha_i$ is a value between 0 and 1 that estimates the number of MDCT coefficients that will be quantized to non-zero values. The $\alpha_i$ parameter, which is a function of the value of the scale factor, is optional (if omitted, it is replaced by a constant value equal to 1) but greatly improves the performance of the algorithm if it is estimated accurately. In this equation, $\alpha_i$ is assumed to be constant if the scale factors are only modified slightly from their preliminary value. For simplicity, this may be achieved by counting the number of MDCT coefficients in a band that has an absolute value greater than some predefined threshold.

For the scale factor bit cost EQN. 2, the new scale factors are only allowed to take on values greater than or equal to the preliminary values, hence the system cannot decrease the bits allocated to a band but can only increase the number of bits if the additional bits resulting from an increased scale factor is cheaper than the differential coded cost of the scale factors. The function $D(s_i - s_{i-1})$, the Huffman look up of the differential encoded scale factors applied to the original set of scale factors, is a constant in EQN. 2 and may be removed in practice.

It is desired to optimize the scale factor value in each scale factor band so as to minimize the overall number of bits required. One suitable optimization may be achieved by populating a trellis (sometimes referred to as a "lattice") such that its nodes at each consecutive level or stage (scale factor bands "i") are the possible states (scale factor values "k") for that stage and by applying a suitable search algorithm, such as a Viterbi search algorithm, which is a minimum-cost search technique particularly suited for a trellis. In this context, the Viterbi algorithm determines the minimum bit path through the trellis, thereby optimizing the scale factor value in each scale factor band. The Viterbi algorithm computes the best (cheapest) path to each node (scale factor value) in each stage (scale factor band) by finding the best extension (lowest bit rate) from the previous nodes (scale factor values). Such computations are performed for each stage (scale factor band) until the last one. At each stage (scale factor band), the algorithm keeps track of: (1) the best path into each node (scale factor value), and (2) the cumulative cost up to that node (scale factor value). Knowing the best path into a node is equivalent to knowing at each node (scale factor) value the best predecessor node (scale factor) value, thus determining the best path through the trellis and minimizing the overall number of bits required. The scale factor value in each scale factor band is optimized for every successive frame (block) of digital audio. The Viterbi search algorithm is well known. See, for example, Chapter 15 ("Tree and Trellis Encoding") of Vector Quantization and Signal Compression by Allen Gersho and Robert M. Gray, Kluwer Academic Publishers, Boston, 1992, pp. 555-586.

More specifically, to minimize the cost function in EQN. 2, a dynamic programming optimization technique, such as a Viterbi search algorithm, may be employed as follows. A lattice or trellis is constructed with the $k^{th}$ state at the $i^{th}$ stage denoted $S_{k,i}$ and the cumulative cost at any state k and stage i is denoted as $C_{k,i}$. Each state in the lattice represents the possible values of the new scale factor set after optimization. The algorithm is then calculated using the following steps:

1) Initialize i=0 and $C_{k,i}=0$

2) For all k such that $s_{k,i}>s_i$, ($s_i$ are the set of preliminary scale factors) find $$C_{k,i} = \min\left( \alpha_i \frac{(S_{k,i} - s_i)}{4} B_i + D(S_{k,i} - S_{l,i-1}) + C_{l,i-1} \right) \forall\, l \quad \text{(EQN. 3)}$$

3) If i<Number of scale factor bands i=i+1, return to step 2

The new set of scale factors, $\tilde{s}_i$, are the path through the lattice such that $C_{k,i}$ is minimized at the final stage. The Viterbi search algorithm is well understood and efficient implementation techniques are widely available. Alternatives to a Viterbi search algorithm may be employed such as, for example, other lattice optimization techniques.

An example of the application of a Viterbi search algorithm to EQN. 3 is now described in connection with the flowchart of FIG. 2.

Figure 2:
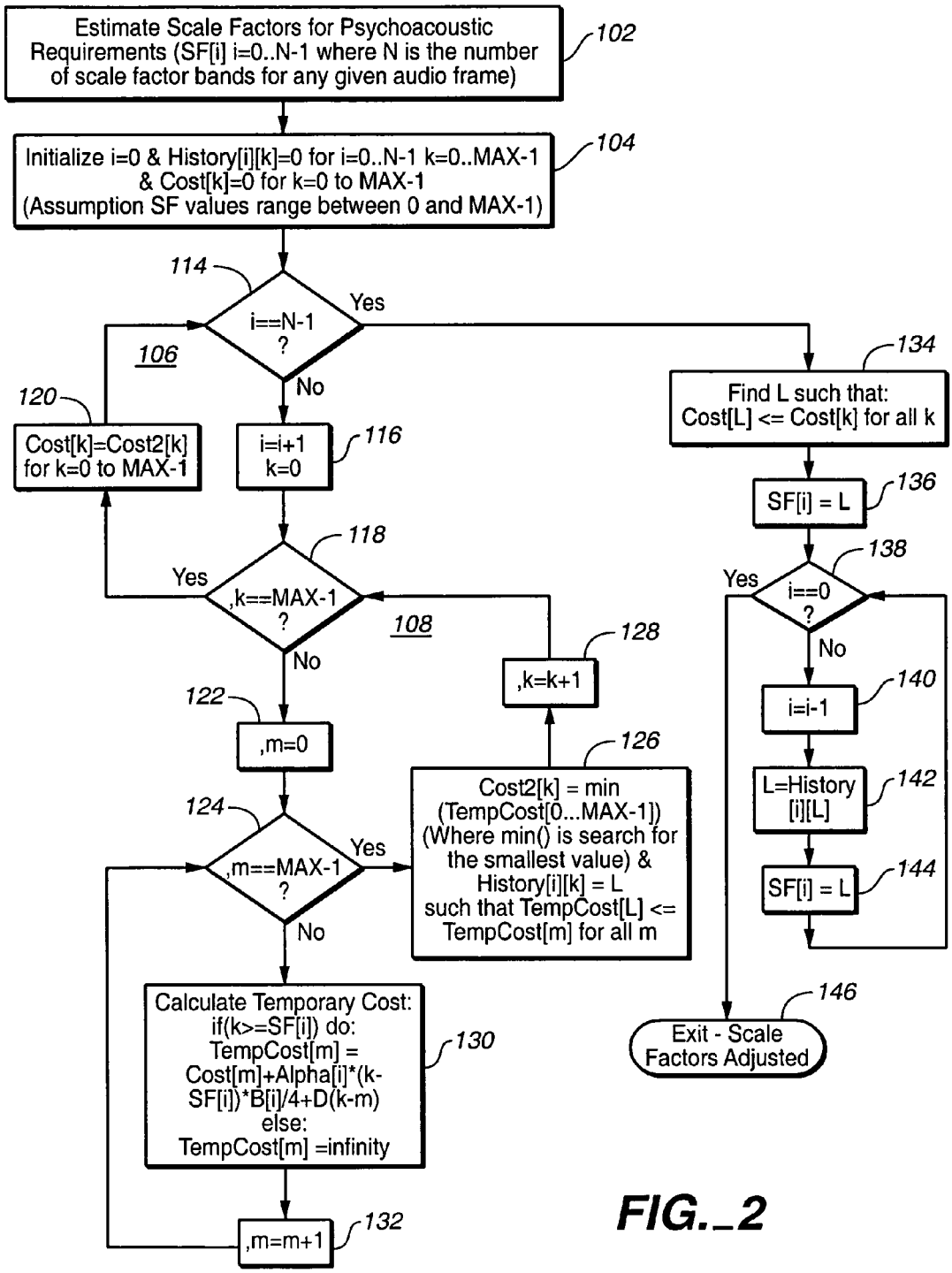
FIG. 2 is a simplified flowchart showing the application of a Viterbi search algorithm to a bit cost equation of the type preferably employed in the present invention.

FIG. 2 shows a flow diagram of a process that employs a Viterbi search algorithm to minimize the cost function of EQN. 3 for every digital audio frame. As indicated in block 102, first, the scale factor for each scale factor band is estimated, taking into account psychoacoustic requirements. This may be accomplished, for example, in the manner described in the paper by Smithers et al, mentioned above.

The scale factors for each scale factor band are represented by an array, SF[i], where the variable "i" may range from zero to N−1, where N is the number of scale factor bands in an audio frame. A second array, Cost[k], represents the cumulative cost of a path through the trellis. A matrix, History [i][k], stores the cheapest path to each node (scale factor value) in a stage (scale factor band) in the trellis. The variable "k" (the scale factor value) may range from zero to MAX−1, where MAX is number of scale factor values.

A stage (scale factor band) counter 'i' is initialized to zero in initializer block 104, which, in addition to initializing the scale factor band "i" to zero, also initializes History [i][k] to zero and Cost[k] to zero. The stage counter is incremented in block 116 until all scale factor bands i are processed as determined by decision block 114.

For each stage (scale factor band) i in the trellis, the cheapest route to each node (scale factor value) k in that stage is determined. This is done using the two nested loops, a loop 108 and a loop 110.

The variable k in decision block 118 is initialized to zero by block 116 and incremented by block 128 of the first nested loop 108, the "k" loop, until all possible scale factor values, represented by the nodes at the $i^{th}$ stage ($i^{th}$ scale factor band) are checked for cost using the second nested loop 110, the "m" loop. In block 130, the second nested loop 110 calculates the cumulative path cost from the $i^{th}-1$ stage ($i^{th}-1$ scale factor band) to the $i^{th}$ stage ($i^{th}$ scale factor band) of the trellis in accordance with EQN. 3 if the scale factor value for the $i^{th}$ scale factor band is greater than or equal to the preliminary scale factor estimate (block 102). If the scale factor is not greater than or equal to the preliminary scale factor for that scale factor band, then the cumulative cost for that scale factor band is set, for example, to an arbitrarily large value to assure that this path through the trellis is not possible. The variable m in decision block 124 is initialized to zero by block 122 and incremented by block 132 of the second nested loop 110. The variable "m" (the number of past path nodes) may range from zero to MAX−1, where MAX is the number of past path nodes.

The cumulative cost for each set of past path nodes is stored in a temporary array, TempCost[m], the value of which is given by:

$$\text{TempCost}[m]=\text{Cost}[m]+\text{Alpha}[i]*(k-SF[i])*B[i]/4+D(k-m),$$

where Alpha[i] is a per scale factor band scaling to compensate for zero quantized MDCT coefficients (see $\alpha_i$ in EQN. 3), B[i] is the scale factor bandwidth (see $B_i$ in EQN. 3) and D( ) is the Huffman table-lookup of the scale factor transmission cost (see EQN. 3). The temporary cumulative cost is calculated and stored for all possible values of the past pathmap nodes m in block 130. Once the cumulative costs for transition from each of the possible past nodes, m, to the present node, k, are calculated, as determined by decision block 124, the minimum cost is found and stored in the array Cost2[k] in block 126. Also, the cheapest path to the $i^{th}$ stage and $k^{th}$ node is stored in the matrix History[i][k] in block 126.

Once all present nodes k at the $i^{th}$ stage, have been processed, as determined by decision block 118, the array Cost2[k] is copied into the array Cost[k] in block 120 in a nested i loop 106 and the processing repeats until all scale factor bands have been processed.

Once all bands have been processed, as determined by decision block 114, the array Cost[k] contains the cumulative cost for every path through the trellis. The minimum value in the array Cost[k] is determined by block 134 and the indexto that value (L) identifies the new, adjusted scale factor value for the last scale factor band (i=N−1). An "i" counter is then repeatedly decremented by a second (non-nested) i loop 112, starting from i=N−1 by block 140. The matrix History[i][k] is used to trace back through the trellis to find each prior node along the cheapest path as the scale factor band i steps back from N−1 to zero, thereby identifying the optimum bit cost scale factor value for each scale factor band, which is provided at output 146. This is accomplished in loop 112 by repeatedly decrementing i in block 140 and determining the historical optimum scale factor value k for each scale factor band i in block 142. Block 144 identifies the new, adjusted scale factor value for each backwardly successive scale factor band as i is decremented from N−1 to zero.

Figure 3:
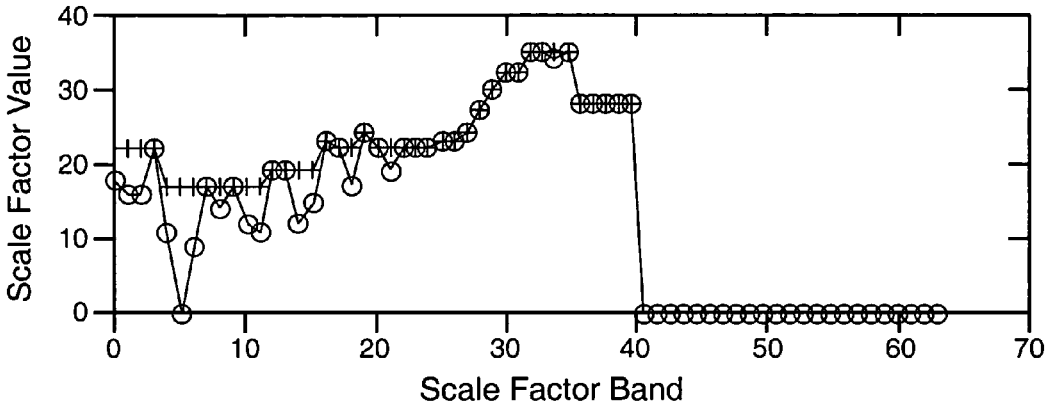
FIG. 3 are plots of exemplary scale factor values versus scale factor bands for the case of preliminary scale factors resulting from a direct scale factor estimation technique and for adjusted scale factors resulting from bit cost optimization according to the present invention.
Figure 4:
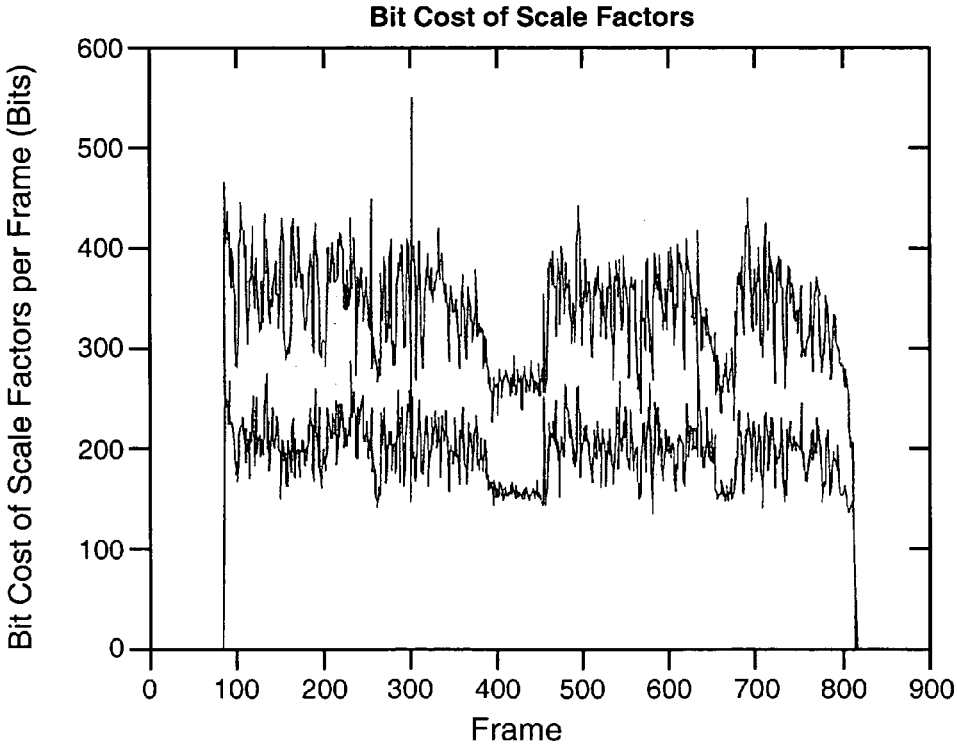
FIG. 4 are plots of exemplary waveforms indicating the bit cost of scale factors per frame resulting from a direct scale factor estimation technique and for adjusted scale factors resulting from bit cost optimization according to the present invention.

FIG. 3 shows the effect of applying the scale factor optimization of the present invention to the preliminary scale factors derived by means of the direct estimation technique for a single AAC audio frame. The circles plotted in FIG. 3 represent the unadjusted scale factors; while the plus plotted points represent the adjusted scale factors according to an application of the present invention. The scale factor optimization technique according to the present invention greatly reduces the variation in the scale factors. Also the adjusted scale factors are always increased, not just saving bits overall but decreasing the quantization noise not only in the bands in which the scale factors are increased, but also in other bands as a result of overall bit savings (thus allowing more bits to be allocated to other bands). The bit savings achieved by this technique are shown in FIG. 4, which plots the cost of transmitting the scale factors per frame of a single audio segment, both with and without the use of the optimization according to the present invention. The upper line in FIG. 4 is the cost of transmission without the use of the present invention, while the lower line shows the bit cost of transmission with the use of the present invention. From FIG. 4, it will be seen that the bit cost per frame for the transmission of the scale factors is greatly reduced by the present invention.

It should be understood that implementation of other variations and modifications of the invention and its various aspects will be apparent to those skilled in the art, and that the invention is not limited by these specific embodiments described. It is therefore contemplated to cover by the present invention any and all modifications, variations, or equivalents that fall within the true spirit and scope of the basic underlying principles disclosed and claimed herein.

The present invention and its various aspects may be implemented as software functions performed in digital signal processors, programmed general-purpose digital computers, and/or special purpose digital computers. Interfaces between analog and digital signal streams may be performed in appropriate hardware and/or as functions in software and/or firmware.

I claim:

1. A method for reducing the total bit cost of a perceptual audio encoder employing adaptive bit allocation in which an audio signal is received;

a time domain representation of the audio signal is divided into successive time blocks, each time block is divided into frequency bands, and a scale factor is assigned to each of ones of the frequency bands, wherein the number of bits required to represent each block increases with increases in the scale factor values and with increases in band-to-band variations in scale factor values, comprising determining a preliminary scale factor for said each of ones of the frequency bands, optimizing the scale factor for said each of ones of the frequency bands, said optimizing including increasing the scale factor to a value greater than the preliminary scale factor value for one or more of the frequency bands such that the increase in bit cost of said increasing is the same or less than the reduction in bit cost resulting from the decrease in band-to-band variations in scale factor values resulting from increasing the scale factor for one or more of the frequency bands, and using the optimized scale factors to encode said audio signal.

2. A method according to claim 1 wherein said optimizing includes minimizing a bit cost function.

3. A method according to claim 2 wherein said minimizing minimizes the bit cost of a path through a trellis in which its nodes are the possible scale factor values at each consecutive scale factor band.

4. A method according to claim 3 wherein said minimizing is performed by a Viterbi search algorithm.

5. A method according to any one of claims 1-4 wherein said deriving a preliminary scale factor for said each of ones of the frequency bands employs at least one iterative loop.

6. A method according to any one of claims 1-4 wherein the perceptual audio encoder Huffman encodes the differences between the values of scale factors of neighboring frequency bands, wherein an increase in band-to-band variations in scale factor values increases the number of bits required for the Huffman encoding.

7. A method according to claim 6 wherein said deriving a preliminary scale factor for said each of ones of the frequency bands employs at least one iterative loop.

8. A method according to claim 7 wherein said perceptual audio encoder generates a masking model, and said deriving employs one iterative loop and calculates scale factors based on the masking model.

9. A computer-readable storage medium storing a program for executing the method of any one of claims 1-8.

10. A computer system comprising:

a CPU;

the storage medium of claim 9; and a bus communicatively coupling the CPU and the storage medium.

* * * * *